United States Patent [19]

Yeatts

[11] 4,239,458

[45] Dec. 16, 1980

[54] OIL WELL UNLOADING APPARATUS AND PROCESS

[76] Inventor: Connie M. Yeatts, P.O. Box 366, Bridgeport, Tex. 76026

[21] Appl. No.: 966,619

[22] Filed: Dec. 5, 1978

[51] Int. Cl.[3] ..... F04B 47/12

[52] U.S. Cl. ..... 417/60; 166/68; 417/555 A; 417/556

[58] Field of Search ..... 417/53, 56, 60, 555 R, 417/555 A, 556; 166/68, 153, 156

[56] References Cited

U.S. PATENT DOCUMENTS

| | | | |
|---|---|---|---|
| 2,224,916 | 12/1940 | McFarlane | 417/555 A |
| 2,918,880 | 12/1959 | Jones | 417/555 A |
| 3,181,470 | 5/1965 | Clingman | 417/56 |
| 3,195,523 | 7/1965 | Lyles | 417/60 |
| 4,030,858 | 6/1977 | Coles | 417/56 |

*Primary Examiner*—Carlton R. Croyle
*Assistant Examiner*—Edward Look
*Attorney, Agent, or Firm*—Ely Silverman

[57] ABSTRACT

An internal bypass free piston provides for continuous flow of gas during upward and downward travel of the piston; the piston is structured to rotate during downward travel to equalize wear and the frictional force between wall and piston is utilized to maintain the position of parts of the piston during upward as well as downward travel and is readily adjusted; further, such frictional force is automatically maintained at a higher value during upward motion than in downward motion in the well tubing.

6 Claims, 14 Drawing Figures

OIL WELL UNLOADING APPARATUS AND PROCESS

BACKGROUND OF THE INVENTION

1. Field of Invention

The field of art to which this invention pertains is pumping of oil and gas wells by free pistons.

2. Description of the Prior Art

External bypass piston without any frictional force against tubing walls during downward travel as in U.S. Pat. Nos. 3,304,874 and 3,319,572 do not use frictional forces available during travel down well tubing. Accordingly, such tools travel down well tubing rapidly and such apparatus strike a bottom stop with great force. To absorb such force such apparatuses are usually made very sturdily and such sturdy construction provides a heavy apparatus which then is not readily movable upwards of the tube by only small differentials in pressure. While sealing elements are provided in internal bypass pistons (U.S. Pat. No. 2,762,310) and external guides resiliently urged against well tubing string walls are known (U.S. Pat. No. 3,195,523) unless different forces are applied on upward and downward motion by seal elements to the tubing in which such plungers operate the sealing effect for upward travel is reduced and/or the force to provide change from one orientation of parts to another is so reduced as to make operation unreliable. The adaptability of prior art plungers is limited, each such apparatus being directed to a particular range of gas flows and not readily adapted to others. Also, the continued passage of a plunger in the same relation of plunger parts to the tube wears out tubing and/or plunger parts.

SUMMARY OF THE INVENTION

In the operation of the apparatus disclosed, the forceful yet resilient contact of the radial or outside surface of the seal units of the apparatus with the inner surface of a well tubing results in frictional forces therebetween. Such forces are used to automatically maintain an outer shell unit in a position relative to an inner core unit so as to positively maintain open passageways through the piston during downward travel of the apparatus—whereby gas flow through the well tubing is continuous during downward as well as upward travel of the piston—as well as maintain those piston passageways firmly closed during upward travel of the apparatus, with a lesser frictional force during downward than upward travel. Curved surfaces at the top and bottom of core unit plates act like a turbine blade to rotate the piston about its longitudinal axis while the piston travels downward through the well tubing whereby the components of the piston that contact the interior surface of the well tubing are not subject to repeated stress at the same points.

BRIEF DESCRIPTION OF DRAWINGS

FIG. 3 is partly a sectional view and partly a side view; it is taken generally along the composite longitudinal section indicated as 3A-3B-3C-3D-3E-3F of FIG. 7: the parts of that longitudinal section extend parallel to the length of the apparatus 20. More particularly, FIG. 3 is a composite sectional view along the broken section 3G-3H-3I-3J-3K of FIG. 1, all portions of that broken section passing through the apparatus 20 parallel to plane 3A–3F of FIG. 7. The section 3A–3F is broken at 3B-3C-3D-3E to show core unit 21 in side view. The plane of all of section portions 3G, 3I and 3K are co-planar; the planes of section portions 3H and 3J are co-planar. The plane of section portions 3H and 3J are displaced from the plane of section portions 3G, 3I and 3K for purposes of clarity in view of details shown near parts of sections 3I, 3J and 3K to a larger scale in FIG. 9.

FIG. 5 is partly longitudinal sectional view and partly a side view; it is taken generally along the composite longitudinal section 5A-5B-5C-5D-5E-5F of FIG. 6: the parts of that longitudinal section extend parallel to the length of the apparatus 20. More particularly, that FIG. 5 is also a composite sectional view along the broken section 5G-5H-5I-5J-5K of FIG. 4, all portions of that broken section passing through the apparatus 20 parallel to plane 5A–5F of FIG. 6. The section 5A–5F is broken at 5B-5C-5D-5E to show core unit 21 in side view. Each of the planes of sections 3A–3F of FIG. 7 and the planes of sections 5A–5F of FIG. 6 are respectively identical (although position of parts seen at such views are not). Each of the planes 3G–3K of FIG. 1 and the planes of sections 5G–5K of FIG. 4 are, respectively, identical (although the position of parts seen at such views are not).

In FIGS. 3, 5, 6, and 7 the springs 106 and 116 are shown only diagrammatically in their expanded and contracted forms and such showing of those springs is not to scale.

DESCRIPTION OF THE PREFERRED EMBODIMENT

Figure 1:
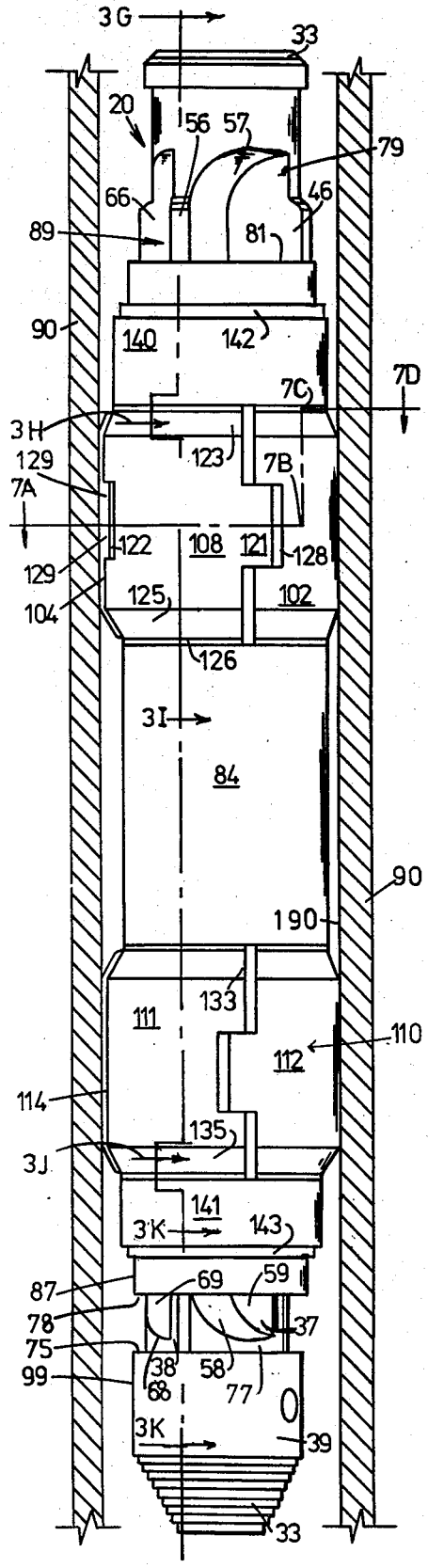
FIG. 1 is a side view which shows the overall apparatus 20 in a well tube 90 in the orientation of parts of apparatus 20 during downward travel of apparatus 20 as shown diagrammatically in FIG. 10, with tube 90 shown in section.

The oil well unloading apparatus 20 comprises an inner or central core unit or assembly 21 and an outer shell assembly 23; the inner or central core unit or assembly extends longitudinally and is located slidably in a longitudinal direction within the shell assembly.

The central core unit 22 is a rigid axially symmetrical unit. It comprises a cylindrical head 33 and neck 32, cruciform assembly of plates 35–38, and a cylindrical body 31 serially continuous and firmly joined together as shown in FIGS. 3, 5, 6 and 7 and a core foot 39. It is axially symmetrical about its central longitudinal axis 29. The central longitudinal axis 29 passes through the lower cylindrical body 31 and through the upper cylindrical neck 32. The fishing head 33 is of somewhat larger diameter than the neck 32, is cylindrical and coaxial with the neck 32, and body 31, and firmly attached to the neck 32.

A plurality of rigid core plates 35, 36, 37 and 38 extend radially from the central longitudinal axis 29 with 90° spacing. These plates 35–38 all have the same size and shape and are rigid flat-sided thin plates. Each plate as 37 has a flat straight edge comprising portions 41, 42 and 43. These straight portions are separated by recess portions as 42 and 44. A projecting shoulder portion 46 is located at the upper end of the edge 41.

The plates 35, 36 and 38 are identical to plate 37. Thus, plate 38 has straight radial edge portions as 51, 53 and 55 with recesses 52 and 54 therebetween and a shoulder 56. Similarly, plate 35 has straight edges 61, 63 and 65 with recesses 62 and 64 therebetween. The center portion of recesses as 44, 54 and 64 are at the same distance from the bottom end of the core 31 and each of the recesses as 42, 52 and 62 are of the same size and shape and located at the same distance from the bottom of the core unit 21. The shoulders as 46, 56 and 66 are located in the same horizontal plane, as shown in FIGS. 3, 4 and 5, when the axis 29 of the core 31 is vertical as shown in FIGS. 1–5 and FIGS. 10–12.

The radial or outer edge of each of the plates as 38 has an upper curved lip 57 and bottom curved lip 58; lip 57 extends from the right side edge of the shoulder as 56 to a point as 157 on the adjacent plate as 37 above the top edge of the shoulder 46 of that plate 37 so that the curved surface portion 57 extends upwardly and to one side of each shoulder as 56. Thus, an upper curved lip edge portion 57 extends in a downwardly concave form from the upper portion of plate 38 above lower edge 156 of shoulder 56 to the portion of the plate 38 to the right thereof (shown in FIGS. 3 and 5) at a point as 157 spaced away from and above the top of shoulder 46. Additionally, the plate 35 has an upper curved lip portion 67 which extends with a downwardly concave shape upward and toward the adjacent plate 38, as shown in FIGS. 3, 4 and 5 and extends to a point 60 above the top of the shoulder portion 56 on plate 38.

Figure 3:
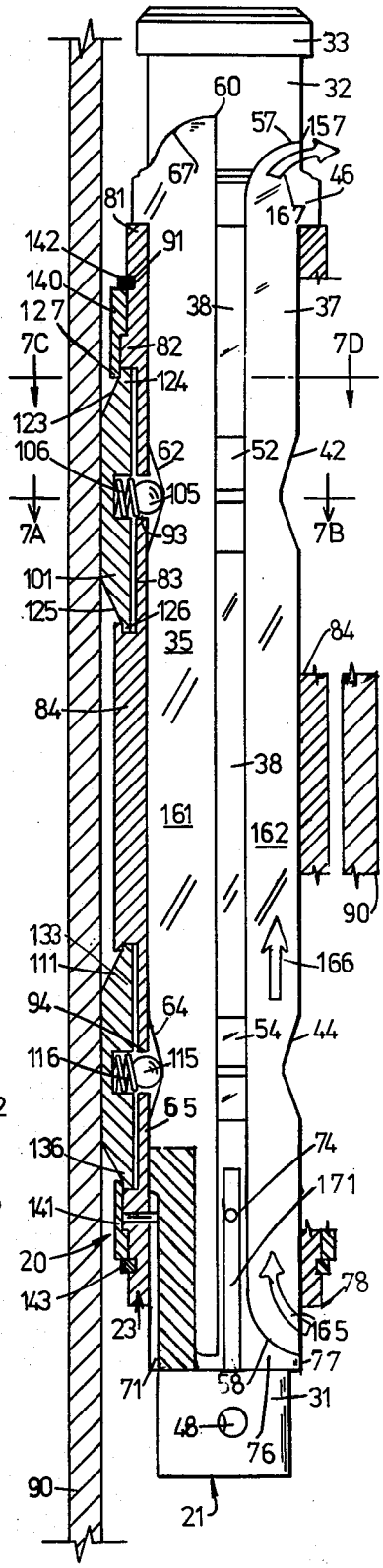
FIG. 3 shows the relations of parts of the assembled shell unit 23, shown in section, to the central core unit 21, shown in side view, during the positions of parts shown in FIG. 1.
Figure 4:
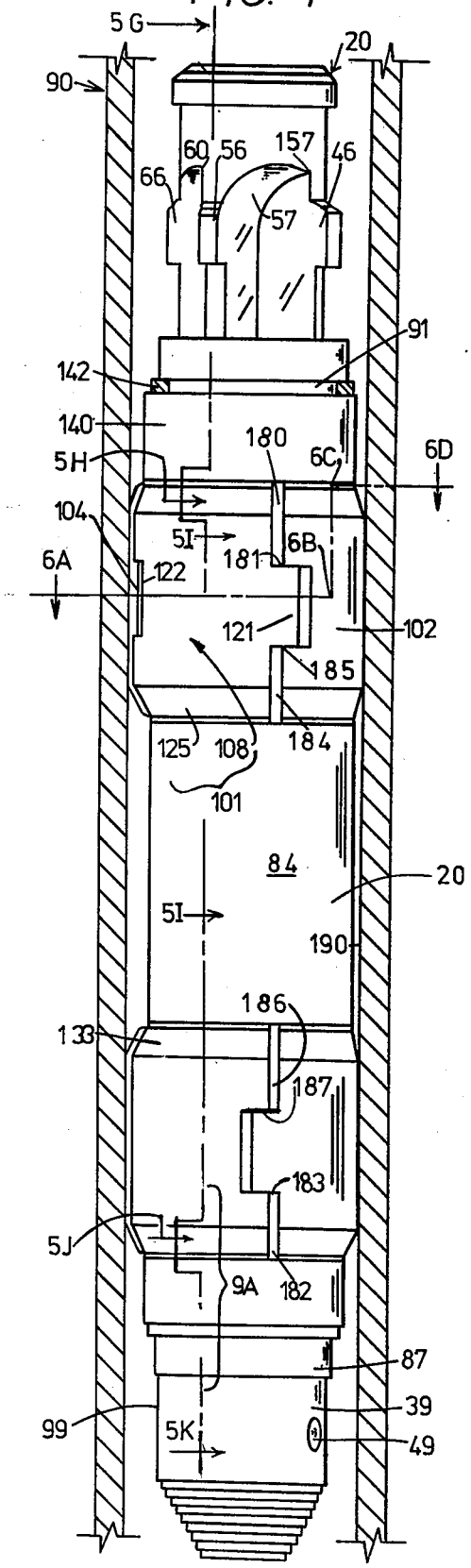
FIG. 4 is a side view which shows the overall apparatus 20 in a well tube 90 in the orientation of parts of apparatus 20 during upward travel of apparatus 20, as shown diagrammatically in FIG. 11, with tube 90 shown in section.
Figure 5:
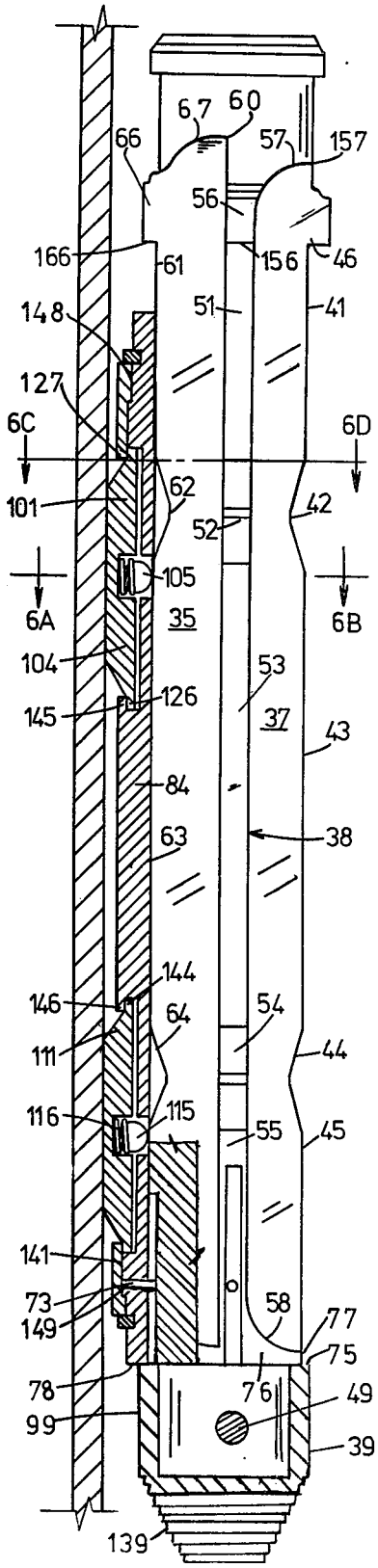
FIG. 5 shows the relations of parts of the assembled shell unit 23, shown in section, to the central core unit 21, shown in side view, during the positions of parts shown in FIG. 4.

Similarly, the bottom portion of each plate as 38 has a lower upwardly concave curved portion as 58 which extends downward and to the right in a curved manner as shown in FIGS. 3 and 5 toward the adjacent plate as 37. As shown in FIG. 1, in the downward moving position of parts of the apparatus 20 this provides an orifice 59 between the core element 21 and the shell base unit 22.

A slot as 71 and 171 is provided in the lower portion of each of the plates, as shown for 35 and 38 respectively, for reception of guide pins as 73 and 74 for slidable movement of the shell base unit 22 with respect to the assembled shell unit 23.

Figure 6:
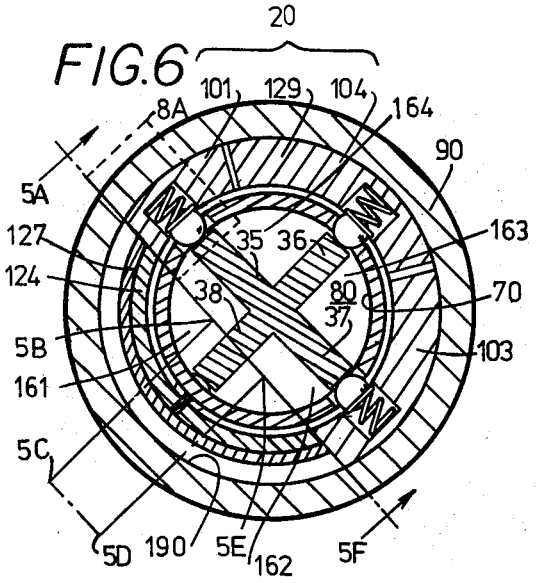
FIG. 6 is a composite transverse sectional view; the portion of FIG. 6 to upper right of plane 5A–5F of FIG. 6 is a transverse sectional view taken along the plane 6A–6B of FIG. 4 and FIG. 5, that plane and plane 6A–6B being transverse to the longitudinal axis of the central core unit 21. The portion of FIG. 6 to lower left of plane 5A–5F of FIG. 6 is a transverse sectional view taken along plane 6C–6D of FIG. 4 and FIG. 5.
Figure 7:
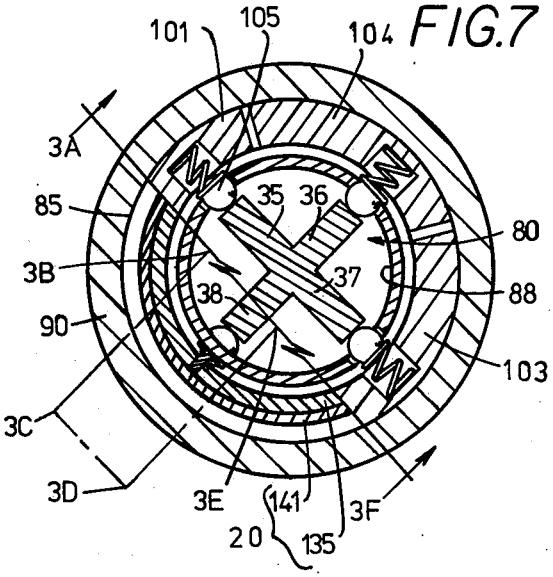
FIG. 7 is a composite transverse sectional view; the portion of FIG. 7 to upper right of plane 3A–3F of FIG. 7 is a transverse sectional view taken along the plane 7A–7B of FIG. 1 and FIG. 3, that plane and plane 7A–7B being transverse to the longitudinal axis of the central core unit 21. The portion of FIG. 7 to lower left of plane 3A–3F of FIG. 7 is a transverse sectional view taken along plane 7C–7D of FIG. 1 and FIG. 3.
Figure 8:
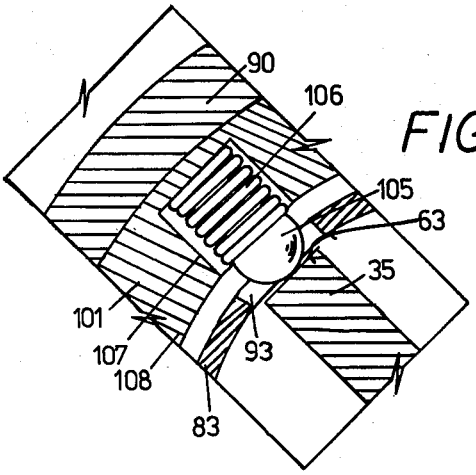
FIG. 8 is a diagrammatic enlarged view of zone 8A of FIG. 6.

The shell base unit 22 comprises, in operative and firm combination, a cylindrical base unit top end cylinder 81, a cylindrical base unit upper shoulder 82 of larger diameter than the top end cylinder 81, an upper cylindrical tubing 83 coaxial with and continuous with inner portion of the shoulder 82, as shown in FIG. 3 but of lesser outer diameter than at shoulder 82, a cylindrical base unit middle shoulder 84 of larger diameter than the upper tubing 83, a lower cylindrical shell base unit tubing 85, said lower tubing 85 being continuous with the shell base unit middle shoulder 84 and same size as tubing 83, a cylindrical lower base unit shoulder 86 of the same size as the shell base unit upper shoulder 82, and a cylindrical base unit lower end cylinder 87 of the same size as shell base unit upper end cylinder 81. Elements 81, 82, 83, 84, 85, 86 and 87 are all coaxial and have the same internal cylindrical surface 88, as shown in FIGS. 6 and 7. The internal diameter of surface 88 is slightly larger, e.g., perhaps 10 or 20 thousandths of an inch, to provide a smooth sliding fit over the exterior straight edges as 43, 53 and 63 of the core plates as 35, 36, 37 and 38 as is shown in FIGS. 3, 5, 6 and 8.

Figure 2:
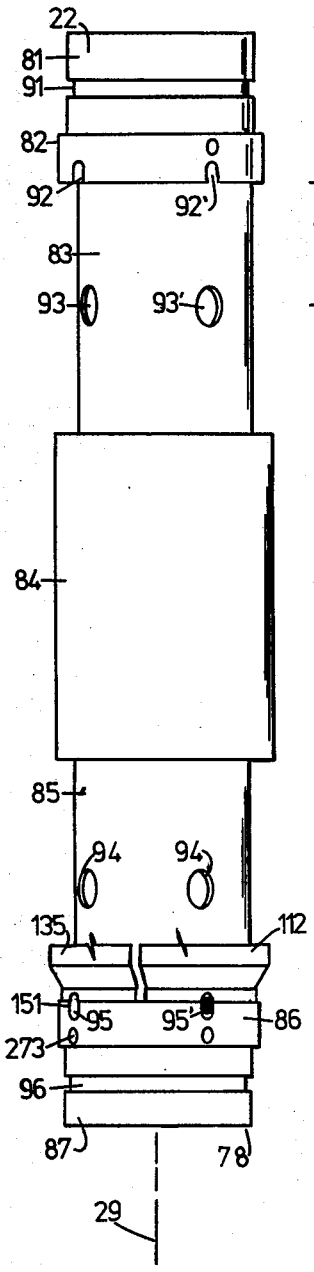
FIG. 2 is a side view of the shell base unit 22.

A ring recess is provided in the upper sleeve 81 and four orienting downwardly open key recesses as 92 and 92′ are located in the base unit upper shoulder, as shown in FIG. 2. Additionally, four locking ball retainer passages are equispaced around and located in the upper base unit tubing 83. These passages as 93 and 93′ are circular and are located with their centers in the same plane transverse to the longitudinal axis of shell base unit 22; a lower set of four circular locking ball retainer passages also is located in the lower tubing 85. The holes as 94 and 94′ forming such set are, like 93 and 93′, located at 90° spacings from each other in series and are located with their centers in a flat plane transverse to the longitudinal axis of the cylindrical base unit shell 22.

Four upwardly open extending key recesses as 95 and 95′ are located in the lower shell base unit shoulder 86. These are all of the same size and parallel to each other and located each in a line with an upper shoulder key recess and two ball retainer passages as 92, 93 and 94 as shown in FIG. 2. Collar 86 has a series of like radially extending cylindrical holes as 273 behind each of recesses as 95 for each of pins as 73.

A lower ring recess 96 is an annular slot located in the radial surface of the lower end cylinder 87 of the base unit 22.

A plurality of seal units as 101–104 form an upper seal assembly 100 and a plurality of like seal units form a lower seal unit assembly 110. Each of the upper seal units 101, 102, 103 and 104 are alike and are arrayed circumferentially of and adjacent or neighboring to the upper shell base unit tubing 83. Each of the lower seal units 111–114 are alike and are arrayed circumferentially of the lower tubing 85 of the base unit 22.

Each of the seal units as 101 is provided with a seal unit ball 105 and a seal unit spring 106. A cylindrical spring locating recess 107 in the body 108 of the seal unit 101 houses and firmly locates the helical spring as 106 and that spring in turn locates the locking seal unit ball 105 within a hole as 93 in the upper base unit tubing 83.

Figure 10:
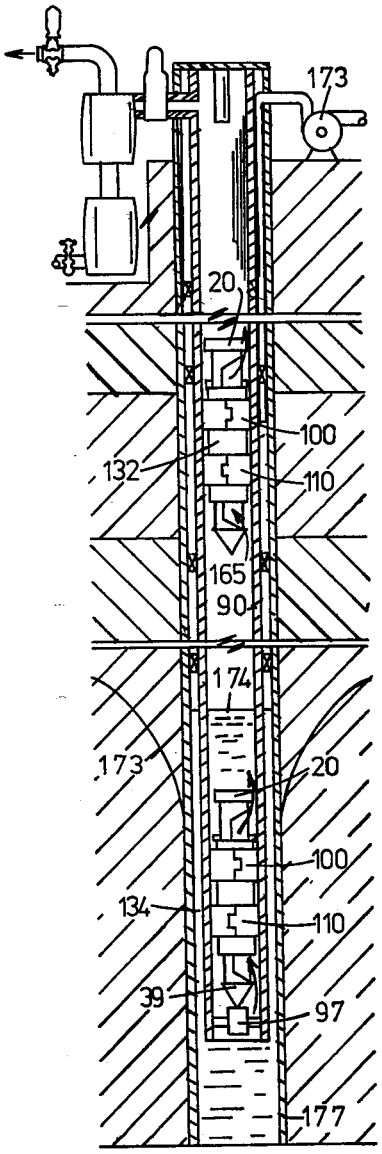
FIG. 10 is a diagrammatic longitudinal sectional view through a well tubing and diagrammatically shows the position of the apparatus 20 and its parts on two successive operating stages of downward motion of the apparatus 20 through the well tubing 90.
Figure 11:
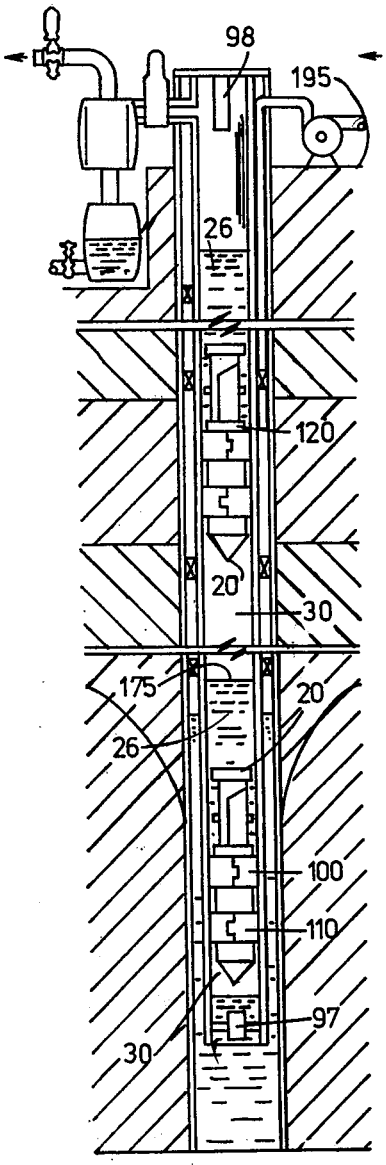
FIG. 11 is a view as in FIG. 10 to show position of the apparatus 20 and its parts during stages of its operation during which said apparatus is rising within the well tubing 90.
Figure 12:
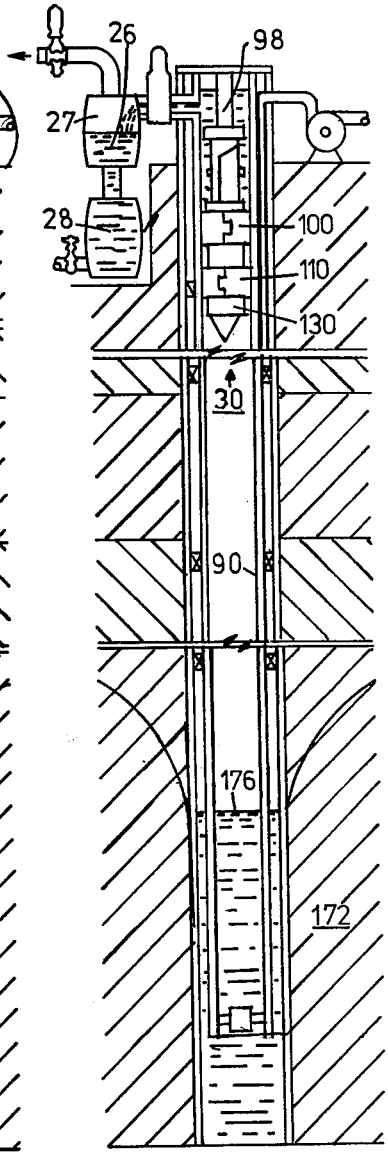
FIG. 12 shows parts of the apparatus 20 near the termination of its upward path, and related nearby structures as shown in FIGS. 10 and 11.
Figure 13:
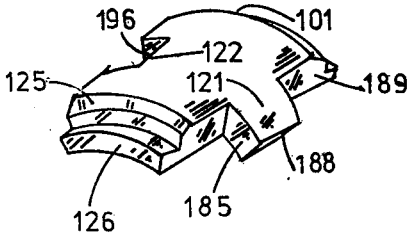
FIG. 13 is an oblique diagrammatic view of a seal unit 101 as seen from its bottom end and outer surface.
Figure 14:
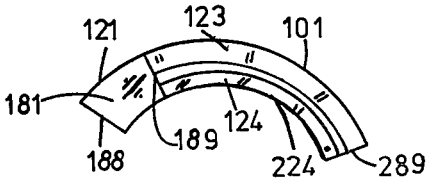
FIG. 14 is an end view of seal unit 101 as seen from its upper end.

Each of the seal units as 101–104 comprises a shaped cylindrical segment which has an inner surface which matches the outside curvature of the base unit tubing as 83 and an outer surface which has substantially the radius of curvature of the interior tubing 90 with which such seal unit is to engage during operation as in FIGS. 10–12.

Figure 9:
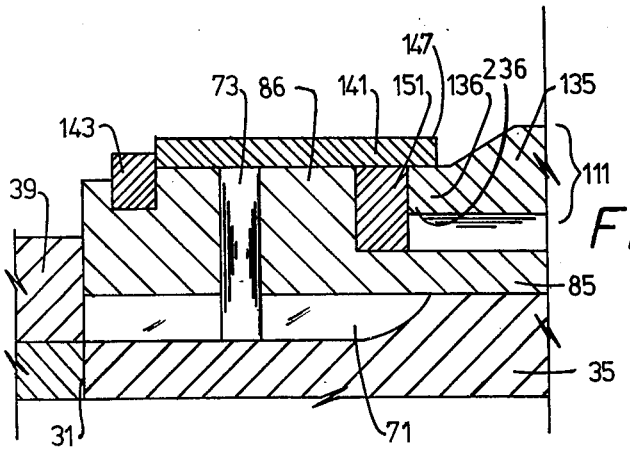
FIG. 9 is an enlarged diagrammatic view of zone 9A of FIG. 4 along the plane of section 5I–5K of FIG. 4: it shows details not shown in section 5J of FIG. 4 or section 3J of FIG. 1.

Each seal unit as 101 comprises a cylindrical shell body 108 with bevelled portions 123 and 125, a tongue 121, a recess 122, and rims 124 and 126. Body 108 is a rigid longitudinally extending segment of a tube or hollow cylinder, such segment curved in form of a cylindrical shell or tube having a central longitudinal center of curvature or axis parallel to the length of that segment. Body 108 has, on one side thereof and tangentially projecting in one, rightward (as shown in FIG. 1) direction, a tongue 121. On the other side of the body 108 there is a corresponding transverse recess 122. At the upper end of the body 108 is an upper conically bevelled portion 123 and, at the lower portion of body 108 is a lower bevelled portion 125. At the upper end of the bevelled portion 123 is an upper rim 124. At the lower end of the lower conically bevelled portion 125 is a lower rim 126. The transverse tongue 121 of element 101 fits slideably into a corresponding recess 128 of an adjacent seal unit as 102. That recess 128, corresponds to the transverse recess 122 of the unit 101 in shape and size. Additionally, a tongue 129 of the element 104 projects into the recess 122 of unit 101. Each of the seal units as 101–104 and 111–114 have the same structure so the description given for seal unit 101 applies to all the other seal units. Thusly, the seal unit 111 has a lower bevelled portion 135 corresponding to the lower bevelled portion 125 of seal unit 101 and that bevelled portion 135 has a lower projecting rim 136 corresponding to the lower rim 126 of seal unit 101. Each of the rims as 124 and 126, and 136 is, as shown in FIGS. 3, 5, and 9 of a lesser outer diameter than the remainder of the seal unit to which attached.

The upper rim 124 is held against outward movement by the peripheral portion or shoulder 127 of collar 140 at its upper end and at its lower end by the like shoulder 145 (of shoulder 84). Each of collars as 140 and 141 is, respectively, held against longitudinal movement by an upper lock ring 142 and a lower lock ring 143; those lock rings are, respectively held in the upper ring recess 91 and the lower ring recess 96.

The lower seal unit 111 has an upper locking rim 144 like the upper locking rim 124 on the upper seal unit 101. Such seal unit upper rim 144 is, held against outward movement by a peripheral lower shoulder 146 of the middle unit 84 in the same manner as rim 124 is held by the peripheral portion 127 of upper collar 140, as shown in FIGS. 1, 3 and 5.

A longitudinal rim lock key 151, shown in FIG. 2, is provided for each rim, as 136, of each seal unit, as 111. While key 151 is shown in detail in FIG. 9 only for the unit 111, all of the slots, as 92, 92', 95 and 95' are provided with such keys with which to lock all of the seal units 101–104 and 111–114 against tangential movement along the surface of the adjacent tubing as 83 or 85; e.g., units 113 and 114 are provided with similar slots and keys.

The wearing parts—the seal units 101–105 and 111–115 are readily replaced so wear does not affect the performance of the apparatus 20 and especially as the springs as 105 compensate for such wear.

Normal pipe strings forming the well tube 90 have discontinuities and irregularities at the junction of each length, usually about 20 feet.

Passage of the usual free piston past such junctions causes some wear if not malfunction.

The wearing parts (seal units 101–104 and 111–114) are readily replaced by removing the lock rings as 142 and 143 and collars as 140 and 141 whereupon the sealing units are removable and readily replaced.

The bevelled portions as 123 and 125 on seal unit 121 and corresponding bevelled portions 133 and 135 on the seal unit 111 accommodate to small changes in internal diameter as are usually met at such junctions.

The core foot 39 is a solid heavy piece of steel which has a lower conical frustum shape with the apex of such frustum pointed downwardly and an upper cylindrical sleeve 99. This foot is firmly held to the lower body 31 by a pin 49 and is coaxial with the axis 29 of core unit 21. The foot 39 is a replaceable element and also is one which provides for adjustment of weight by provision of different weights e.g., by different length of such foot, for operation in wells where there are higher rates of gas flow. That foot has a flat top face 75 which is of larger diameter than the outer diameter of tube 31 and, also, is wider at its upper cylindrical portion 99 and top face 75 than the diameter of plates as 35 and 37, as is shown in FIG. 5 and FIG. 1. This provides that the top surface 75 of foot 39 provides a base or shoulder against which the lower face 78 of the unit 23 may rest in the upwardly moving position of parts of the apparatus 20,—which position of parts is shown in FIGS. 4, 5, 11 and 12—and form a seal over orifices as 69 and 59 as below discussed.

A longitudinally extending radially open slot 71 is provided in the radial edge of plate 35; a corresponding slot 171 is provided in the plate 38 and a corresponding slot is also provided in the plate 37 and a like slot (not shown) is provided in plate 36. Pin 73 is readily slidable in slot 71, which is a straight slot parallel to the axis 29 of the base unit 22 and core unit 21, and provides for maintaining the angular orientation of the core unit 21 relative to the shell base unit 22 inasmuch as the pin 73, as shown in FIG. 9 firmly engages the lower shoulder 86 of the shell base unit 22. That pin is held in place by the collar 141 and that collar in turn is held in place by the ring 143. The collar 141 also holds the key 151 in place. Similarly, the collar 140 holds in place the rims of the seal units 101–104 and keys like key 151 for the units 101–104.

In operation the core unit 21 is held against the shoulders as 46, 56 and 66 of the plates 37, 38 and 35 respectively while the apparatus 20 moves downward of tubing 90. On such motion the gas in the tubing 90 flows (a)

inward along paths as 165 into the orifice as 59 between the lower edge 78 of the shell unit 23, then (b) through the channels formed by plates 35–38 and surface 88 of shell base unit 22, as by path 166 between plates 38 and 37, shown in FIG. 3 and (c) out of the orifices as 79 located between the upper edge 81 of shell unit and the curved surfaces as 57 and top edge of element 37 as shown by the path 167 in FIG. 3. Similarly, gas flows into the orifice 69 between plates 38 and 35, the shell unit bottom edge 78 and the top of foot 39. This orientation is maintained until the apparatus 20 reaches the position shown at the bottom of the well in FIG. 10 whereat the foot 39 contacts a stop 97, and locking action of balls as 105 and 115 are overcome due to the velocity of the apparatus 20 on its downward motion and force of stop 97 against foot 39, so assembled shell unit 23 moves downward from its position shown in FIGS. 1, 3 and 10 to its position shown in FIGS. 4, 5, and 11. In this position the lower edge 78 of the assembled shell unit 23 engages the top surface 75 of the foot 39 and forms a seal therewith against (and closes) orifices as 69 and 59 and prevents flow of gas through the path theretofore provided, as 166, by the interior of the shell base unit 22, (shell base unit space 80) and shell base unit interior surface 88 and the surfaces of the central core unit plates 35, 36, 37 and 38 while seal unit assemblies 100 and 110 seal the outside of the shell base unit 23 against fluid flow therepast. The pressure of the gas in the well raises the apparatus 20 from the position shown at the bottom of FIG. 11 near to stop 97 through the position shown as 120 in FIG. 11, which is an intermediate position between the bottom of the well and the top surface thereof. During this motion, the liquid 26 above the apparatus 20 is sealed and moved upward by such apparatus 20. This movement continues until the apparatus 20 reaches its position shown in FIG. 12 whereat the top of core unit 21 is adjacent the upper stop 98 and the liquid 26 theretofore carried on top of apparatus 20 passes to a separator 27 and then to a collector 28.

The upper stop as 98 is firmly attached to the top of the well tubing and the momentum of the apparatus 20 causes, after contact of top of unit 21 with stop 98, that the assembled shell unit 23 continues to move upward with respect to the central core unit 21 to a relative position as shown in FIGS. 1, 3 and 10; in such position of core unit 21 and shell unit 23 shown in FIGS. 1, 3 and 10 the orifices 69 and 59 are open, gas flows therethrough by path as 165, 166 and 167 past the upper orifices as 79 and 89 and, accordingly, the apparatus 23 falls downward through the well from the position shown as 130 to the position shown as 132 to position shown as 134. At the position 134, whereat the core foot 39 contacts the stop 97, the assembled shell unit 23 continues to move downward relative to the central core unit to a position as in FIGS. 4 and 5 and so closes orifices 69 and 59 and causes the apparatus 22 to again resume its upward movement as shown in FIGS. 11 and 12.

In the above described operation of the apparatus 20 in well tubing as 90 the forceful yet resilient contact of the radial or outside surface of each of the seal units as 101–105 and 111–115 with the central or inner surface of the tubing 90 as shown in FIGS. 1, 4, 6, 7, 10, and 11 results in a frictional force therebetween resisting the motion of the apparatus 20. Such force serves to (a) maintain the shell unit 23 in a position relative to the core unit 21 as to maintain the operating relations which develops such force and to (b) maintain the operating relations of the core unit 21 and shell unit 23 namely, maintaining open the passage ways as 69 and 59 during downward travel of the apparatus 20 and maintaining those orifices closed during upward movement of the apparatus 20 as in FIG. 11.

Accordingly, on upward motion the sleeve 23 is forced downward relative to the core unit 21 and the upper face 75 of the foot 39; thereupon the face 78 of the collar 87 engages the upwardly directed horizontal face 75 of the foot 39. At the same time the interior surface 88 of the sleeve base unit 22 engages all cylindrical surface segments as 76 of the core unit and further and securely blocks the orifices as 59, which orifices are located between the curved surface 58 of the plate 38 and the neighboring surface of the plate 37. Such orifice is shown in FIG. 1. The path 166 through orifice 59 and the path 167 through orifice 79 are shown in FIG. 2.

The downward moving face 78, when it engages the face 75 also closes other orifices, such as 69 adjacent the plate 38 and the plate 35. The cylindrical surface segments as 76 are located between the curved surface 58 and the upper surface 75 of the foot 39.

The bottom curved core unit surfaces as 68 and 58 and the core unit upper curved surfaces as 57 and 67 are located adjacent each flat plate as 38 and 35 respectively as shown in FIGS. 3 and 5. Fluid passages 161, 162, 163 and 164 are formed by the plates 35, 36, 37 and 38 and the curved surfaces as 57 and 58 and the interior surface 88 of the core base unit 22. Gases flow through passages 161–164 during downward motion of the apparatus 20 in the well tubing 90 (as shown in FIG. 10), those then upwardly (relative to apparatus 20) flowing gases travel in paths as shown by arrows 165, 166 and 167 in FIG. 3 and impinge on the curved surfaces, as 58 and 68 of each such plate as 35 and 38, respectively; those relatively upwardly flowing gases then flow in tangential directions relative to the inner cylindrical surface 88 e.g., toward plate 38 from plate 37 along surface 58 and toward plate 35 from plate 38 along curved surface 68. Additionally, each upper curved surface, as 57 and 67 adjacent each plate as 38 and 35 respectively, provides that the gases and liquids flowing upwards relative to apparatus 20 in channels as 162 and 161 exert a reactive force against such upper curved surface as 57 on passing outwards of each adjacent orifice as 79 and 89. Such reactive force is applied against each curved surface as 57 and the plate to which attached, as 38 in the same direction as the impact force against the lower curved surface (58) of that same plate (38) provided by such gas or liquid when passing into the fluid passage (as 162) against that same plate (38). Accordingly each of the plates 35, 36, 37, and 38 with the curved surfaces as 57 and 58 at its top and bottom acts like a turbine blade and tends to and does rotate the core unit 21 about its longitudinal axis 29 while the core unit 21 travels downward through the tubing 90. Because the core unit 21 is non rotatably connected to the shell base unit 22 by the pins as 73 and 74, when the core rotates it also rotates the seal units 101–105 and 111–115, which are firmly held in place relative to base unit 22 by the keys as 151 in each of the recesses as 92, 92', 95 and 95'. Thereby those units 101–104 and 111–114 that contact the interior surface 190 of the well tubing 90 are not subject to repeated stress at the same point on passing down tubing 90. This concurrent rotation of core unit 21 and shell unit 23 also provides that the apparatus 20 is located with a different angular orientation of its parts about axis 29 relative to tubing 90 on each successive upward trip of apparatus 20 in tubing 90, as in FIGS. 11 and 12, although shell assembly 23 and core unit 21 are longitudinally movable relative to each other.

Gases 30 evolved from the oil and gas producing formation 172 or added by a pump 173 flow upwardly in tubing 90, are used by apparatus 20 while continuously flowing through tubing 90 to the surface, whereby liquid then above the apparatus 20, as shown in FIG. 11, is moved (by the gas 30) upwards of the tubing 90. The gas pressure lifts the apparatus 20 and the column of liquid 26 thereabove, as shown in FIG. 11, at the stop 97 and, thereafter, at elevated positions as 120, below the surface 195, serves to pass the liquid into a separator tank 27 from top of which gas is drawn and liquid recovered from its bottom, as at 28.

The cross section of the bottom of the core unit 21 then exposed to the upwardly flowing gases, (such cross section) measured by the area of cross section transverse to the longitudinal axis 29 is slightly less than the transverse cross section area similarly measured of the shell unit 23 (exposed to the gases therebelow) and the weight of the shell unit 23 per unit cross section area exposed to the upwardly flowing gas is less than the weight of the core unit 21 per unit cross section area exposed to the upwardly moving gas. Thus, on motion of apparatus 20 upwards of the tubing 90 when the orifices as 59 and 69 are closed, the upward force on the core unit 21 by the gases therebelow applied to the downwardly facing surfaces of the apparatus 20 is less than the total upward gaseous force on the assembled shell unit 23 but, at that time, the frictional force of the interior surface 190 of the wall of the tubing 90 against the outer surface of the seal unit assemblies 100 and 110 serves to hold the shell assembly 23 downward relative to the central core unit 21, hence presses flat surface 78 at bottom of core unit 21 against flat surface 75 on top of foot 39, whereby all the theretofore open inlet orifices as 59 and 69 are firmly closed.

The generally conical shape of the foot 39 of the core unit 21 and the large straight surfaces of plates 35–38 and the fact that the upper outlet orifices as 79 and 89 at the top of the passages as 161–164 are larger than the lower inlet orifices as 59 and 69 at the bottom of such passages minimizes fluid dynamic upward forces on the upper curved core unit surfaces as 57 and 67 relative to the shell unit 23 during passage of the core unit 21 and apparatus 20 downward of well tubing 90. The shape of indentations as 52, 54, 62 and 64 and location on the plates therefor provide that each of the locking balls as 105 locate in the indentations as 62 therefor only when the assembly 23 is in the position, as shown in FIGS. 1, 3 and 7 for moving downward of tube 90.

The locking action of the balls as 105 and 115 in each of the indentations as 62 and 64 in plate 35 and the like action of like balls in like indentations as 52 and 54 in plate 38 and like action for the like locking balls for and indentations in all of the plates 35–38, provides a trigger-like rapid moving of the core unit 21 in place relative to the shell unit 23 for downward motion of the apparatus 20 in the tubing 90 when the top of the core unit 21 in the upwardly moving apparatus 20 contacts the top stop 98, as shown at position 130 of FIG. 12.

The curved upper core unit surface 57 extends from the middle of shoulder 56 to a point as 157 above the adjacent shoulder 46 on plate 37. The lower inlet orifice 59 is formed by the lower curved surface as 58 and surface 78. The surfaces 57 and 58 are mirror images of each other but the area between the downwardly facing flat surface 78 and bottom of surfaces 58 and 68 at the bottom orifices is less than the area between the top surface 81 and the tops of the curved surfaces as 57 and 67 in the falling orientation of apparatus 20, as shown in FIGS. 1 and 10. The upper orifice 57 and 67 are accordingly larger in cross sectional area than the lower orifices as 59 and 69.

The upper and lower intersegmental spaces as 180 and 184 between seal units as 101 and 102 and upper and lower transversely extending edges as 181 and 185 in the upper set of seal units 100 act as cutting surfaces to remove paraffin from tubing walls. The lower set of intersegmental spaces as 182 and 186 and transversely extending sealing unit edges as 183 and 187 also act to cut paraffin.

Collars 140 and 141 have interior shoulders 148 and 149 respectively, which shoulders engage the outer edge of the upper end of shoulder 82 and the lower end of shoulder 86 respectively. These shoulders locate the collars 140 and 141 and their edges as 127 and 147. These shoulders limit the movement of those collars toward the base unit middle shoulder 84. The rings 142 and 143 are readily removable to allow replacement of seal units as 101–104 and 111–115.

The string of conventional well tubing 90 shown in FIGS. 10–12 extends from the ground surface 195 to an oil and gas producing formation 172 within a conventional casing 177 and supports stops 97 and 98. The level of liquid in such formation is shown at 173 and the level of liquid in the well tubing is shown at 174, 175 and 176 during different stages of operation of the piston or plunger apparatus 20 in such well tubing string.

The frictional force of apparatus 20 against well tubing 90 is adjusted by reducing spring pressure by deepening indentations as 62 and 64 and/or deepening holes as 106 or increasing tension by adding washers to holes as 106 while the travel rate of apparatus 20 down well tubing 90 is also adjustable by replacing foot 39 with a longer or shorter conical portion 139. Each of the rims as 124 and 136 adjacent a collar, as 82 and 86 provided with collar slots as 92 and 95 for holding a key as 151, is provided with a seal unit slot, as seal unit slot 236 in seal unit rim 136 and seal unit slot 224 in seal unit rim 124, for reception of a key as 151, which key maintains the alignment of the seal unit with the collar and remainder of core unit 22.

The greater weight of the core unit 21 relative to the shell assembly 23 per unit cross-sectional area transverse to axis 29 and locking action of balls as 105 and 115 in recesses therefor as 62, 64, 42, 44, 52 and 54, as well as friction action between sealing units as 101–104 and 111–114 and tubing wall, maintain open the inlet orifices as 59 and 69 during downward travel of apparatus 20 in tubing string 90.

Table I provides dimensions and characteristics of the preferred embodiment 20, reference there being made to the referent numbers and descriptive terms hereinabove used. (Follow by Insert A.)

INSERT A

TABLE I:

DATA ON EMBODIMENT 20

Length is measured along direction of axis 29 as shown in FIG. 2.
Diameter is measured transverse to direction of axis 29.
Depth is measured transversely to direction of axis 29, radially as shown in FIGS. 6 and 7.
Thickness is measured transversely to direction of axis 29, radially as shown in FIGS. 6 and 7.
Width is measured tangentially (as shown in FIGS. 6 and 7).

| COMPONENTS OF EMBODIMENT | INCHES (METRIC) |
|---|---|
| Core Unit 21 | |
| Head 33 | |
| Top of head to bottom of body 31 | 11 7/16 (28.8 cm) |
| Length | ⅜ (.95 cm) |
| Diameter | 1 11/32 (3.5 cm) |
| Neck 32 | |
| Diameter | 1 7/32 (3.1 cm) |
| Length (bottom of 33 to point 60) | 19/32 (1.6 cm) |
| Shoulders 46, 56, & 66 | |
| Diameter | 1½ (3.9 cm) |
| Distance from shoulder edge 1166 to bottom of 33 | 1 11/32 (3.5 cm) |
| Ribs 35, 36, 37 & 38 | |
| Thickness below shoulders 46 56, & 66 | 7/32 (5.2 cm) |
| Recesses 42, 52, 62, & 64 | |
| Distance across length | ⅞ (2.4 cm) |
| Depth below edges 61, 63, 65 | ⅛ (3.0 cm) |
| Distance, center of recess 62-52 | 4 3/16 (10.7 cm) |
| Distance, center of recess 62 to edge of shoulder 1166 | 1 15/16 (5.0 cm) |
| Surfaces 57, 67, 58, 68, & 76 | |
| Radius of curvature of surfaces 57, 67, 58 & 68 | ½ (1.2 cm) |
| Distance 77 | ⅛ (0.3 cm) |
| Foot 39 | |
| Diameter | 1⅜ (3.5 cm) |
| Cross-sectional area (max.) | 1.48 sq (3.5 sq cm) |
| Weight | 33 oz. (940 gms) |
| Weight per unit area | 22.2 oz/in$^2$ (99 gm/cm$^2$) |
| Base Shell Unit 22 | |
| Length | |
| Top edge to bottom edge 78 | 8¼ (21.1 cm) |
| Cylinders | |
| Length of end cylinder 87 | 9/32 (.9 cm) |
| Diameter, top end cylinder 81 | 1½ (3.8 cm) |
| Shoulders 82 & 86 | |
| Diameter | 1⅝ (3.9 cm) |
| Length | 7/16 (1.1 cm) |
| Shoulder (middle) 84 | |
| Outside diameter | 1¾ (4.5 cm) |
| Length | 2½ (6.3 cm) |
| Tubings 83 & 85 | |
| Outside diameter | 1⅜ (3.6 cm) |
| Length | 1 13/16 (4.6 cm) |
| Slots 92 & 95 | |
| Length | 0.2 (.5 cm) |
| Width | ⅛ (.33 cm) |
| Surface 88, internal diameter | 1¼ (3.2 cm) |
| Hole 273 (for pin 73), diameter | .15 (.38 cm) |
| Holes 93 and 94 | |
| Diameter | .28 (.72 cm) |
| Distance between holes 93 and 94, center to center | 4 3/16 (10.7 cm) |
| Distance of hole 93 from unit 22, top edge | 1 15/16 (5.0 cm) |
| Collar 140 | |
| Length | ¾ (1.9 cm) |
| Diameter | |

TABLE I:-continued

DATA ON EMBODIMENT 20

Length is measured along direction of axis 29 as shown in FIG. 2.
Diameter is measured transverse to direction of axis 29.
Depth is measured transversely to direction of axis 29, radially as shown in FIGS. 6 and 7.
Thickness is measured transversely to direction of axis 29, radially as shown in FIGS. 6 and 7.
Width is measured tangentially (as shown in FIGS. 6 and 7).

| COMPONENTS OF EMBODIMENT | INCHES (METRIC) |
|---|---|
| Outside | 1¾ (4.5 cm) |
| Internal Diameter | |
| Maximum | 1⅝ (4.2 cm) |
| At shoulder 149 | 1 7/16 (3.8 cm) |
| Seal Unit 101 | |
| Length | |
| Top of rim 124 to bottom of rim 126 | 2 (5.1 cm) |
| Rim 124 | |
| Length | ⅛ (.32 cm) |
| Thickness | 3/64 (.15 cm) |
| Tongue 121 | |
| Length | 19/32 (1.5 cm) |
| Width | 7/32 (.52 cm) |
| Slot 122 | |
| Length | ⅝ (1.6 cm) |
| Width | ¼ (.6 cm) |
| Body 108, thickness | 7/32 (.6 cm) |
| Radius of curvature of surface | |
| Internal | 1⅜ (3.6 cm) |
| External | 1 13/16 (4.7 cm) |
| Chord across rim 124, length | 1 (2.5 cm) |
| Bevel 125, length | 3/16 (0.5 cm) |
| Body 108, length (no rims) | 1¾ (4.4 cm) |
| Balls 105, diameter | ¼ (.6 cm) |
| Spring 106 | |
| Length, free | 7/32 (.55 cm) |
| Total length compressed | 3/32 |
| Compressive force on total compression (FIG. 5) | 24½ oz. |
| Compressive force in indentation (FIG. 3) | 10 oz. |
| Unit 101, weight | 3 oz. (85 gm) |
| Face 189 | |
| Length (from face 181 to rim 124, top edge) | 9/16 (1.5 cm) |
| Angle of face 189 to face 289 | 90° (90°) |

Angular distance from face 189 to face 289 is same as angular distance from center line of hole 94 to 93.
Distance from face 189 to face 289 is same as distance from face 188 to parallel face on recess 122.

| Assembled Shell Assembly 23 | |
|---|---|
| Cross-sectional area | |
| Peripheral to 39 exposed downwardly (FIG. 4) | 1.62 sq (10.7 sq cm) |
| Weight | 27 oz (770 gm) |
| Weight per unit cross-sectional area | 16.2 oz/sq in. (72 gm/sq cm) |

Material Used

Seal unit 101
Stainless steel 304 or 316 or equivalent
Base unit 22
Stainless steel 304 or 316 or equivalent
Core unit 21
Stainless steel 304 or 316 or equivalent
Springs
Stainless steel Rockwell C 54-58 squared ends

I claim:

1. An oil well unloading apparatus comprising an inner core assembly and an outer shell assembly;

(a) said inner core assembly extending longitudinally and located slidably in a longitudinal direction within said shell assembly, (1) said inner core assembly comprising an upper head member, a plate assembly and a lower foot, all firmly attached together;

(i) said plate assembly comprising a plurality of like spaced apart axially symmetrically arrayed rigid longitudinally extending flat plates, each of said plates having a longitudinally extending radial edge, each of said plates attached to said foot and to said head member, (ii) each of said plates having (a) an upper shoulder extending radially of said plate's radial edge and (b) a lower tangentially and downward extending surface extending toward an adjacent plate of said plate assembly in a first circumferential direction, (2) said foot having at its top a lower inlet orifice sealing surface located below said tangentially and downward extending surface and said lower orifice sealing surface extending radially of said radial edge of said plates, (3) said head member comprising a rigid plate extending transversely of the length of said plates and attached to the top thereof, (b) said outer shell assembly comprising a base shell unit and a set of seal units, said set comprising a plurality of like seal units, (1) said base shell unit being a hollow rigid member and having at its bottom a transversely extending upper inlet orifice sealing surface and said base shell unit having at its top an upper rigid edge having a greater internal diameter than the external diameter of the radial edges of said plates, (2) said seal units each having an outer surface in the shape of a hollow cylindrical segment, said cylindrical segment being a portion of a right circular cylinder with a central longitudinal axis parallel to the length of said base shell unit, said set of seal units circumscribing said base shell unit and attached thereto movably, (3) holding means on said base shell unit extending radially of and engaging a portion of each said seal unit, (4) said seal units having a portion that extends radially beyond the radial extent of said base shell unit, (5) longitudinal and radially extending openings in said base shell unit and in each of said seal units, and keying members in said openings for radial motion of each said seal unit with respect to said base shell unit, (6) securing means between said core unit and base shell unit for providing only relative longitudinal movement of said core assembly and said base shell unit, (c) each plate shoulder of said core assembly extending above said base shell unit upper edge, said lower inlet orifice sealing surface on said core assembly foot being located below said transversely extending upper inlet orifice sealing surface of said base shell unit, and means extending between said core assembly and said shell assembly for releasably holding said core assembly on one position against longitudinal motion relative to said outer shell assembly.

2. Apparatus as in claim 1 wherein said base shell unit is a hollow rigid cylindrical member and supports a plurality of sets of seal units.

3. Apparatus as in claim 1 wherein each plate also include an upper tangentially and longitudinally extending surface, said surface extending upwards of said upper shoulder on said plate toward an adjacent plate of said assembly in said first circumferential direction.

4. Apparatus as in claim 1 wherein said securing means between said core assembly and said base shell unit for providing only relative longitudinal motion of said core assembly and said base shell unit comprise keying means connecting said inner core assembly and said base shell unit for longitudinal motion therebetween.

5. Apparatus as in claim 3 including also holes through the walls of said base shell unit and spring means passing through said holes in said base shell unit and wherein said means for releasably holding said core assembly against longitudinal motion relative to said outer shell assembly comprises indentations in said plates and spring means held in said segments and a locking ball held by each said spring means.

6. Apparatus as in claim 1 wherein, (a) in one position of parts of said inner core assembly and said outer shell assembly, said base shell unit contacts and extends from the shoulders on said plates of said core assembly downward of said core assembly and said transversely extending upper inlet orifice sealing surface is located (i) above a portion of said lower tangentially and downwardly extending surfaces and (ii) above said lower orifice sealing surface, and (b) in another position of parts of said inner core assembly and said outer shell assembly, said base shell unit extends from below said shoulders on said plates of said core assembly downward of said core assembly and said transversely extending upper inlet orifice sealing surface is located (i) below all portions of said lower tangentially and downwardly extending surfaces and (ii) contacts said lower inlet orifice sealing surface.

* * * * *